United States Patent [19]

Widlak

[11] Patent Number: 4,821,752

[45] Date of Patent: Apr. 18, 1989

[54] ORAL HYGIENE APPARATUS HAVING REPLACEABLE TOOTH ENGAGING CLEANING ELEMENT AND INTERNAL DENTAL FILAMENT DISPENSER

[76] Inventor: Jane Widlak, 4503 Branchview Dr., Arlington, Tex. 76017

[21] Appl. No.: 67,921

[22] Filed: Jun. 29, 1987

[51] Int. Cl.[4] ..... A45D 44/18

[52] U.S. Cl. ..... 132/309; 15/176; 242/146; 401/286; 401/290; 132/311; 132/324

[58] Field of Search ..... 401/286, 290; 132/84 R, 132/84 B, 92 R, 92 A, 84 A; 15/176; 242/138, 146, 137, 137.1

[56] References Cited

U.S. PATENT DOCUMENTS

| | | | |
|---|---|---|---|
| 301,055 | 6/1884 | Greene | 242/137.1 |
| 730,040 | 6/1903 | McKinley et al. | 401/286 |
| 927,844 | 7/1909 | Emerson | 242/146 |
| 1,473,766 | 11/1923 | Healy | 132/84 A |
| 1,642,620 | 9/1927 | Merrill | 132/84 B |
| 1,711,183 | 4/1929 | Smith | 132/84 R |
| 1,797,946 | 3/1931 | Eichel | 401/286 X |
| 2,233,522 | 3/1941 | Fickle | 132/92 R |
| 2,575,960 | 11/1951 | Huntington | 242/137.1 |
| 2,601,244 | 6/1952 | Boulicault | 132/92 R X |
| 2,668,973 | 2/1954 | Glaza et al. | 132/84 R |
| 2,883,692 | 4/1959 | Kaye et al. | 132/84 R |
| 3,789,859 | 2/1974 | Chambers | 132/92 R |
| 3,853,134 | 12/1974 | McCord | 132/92 A |
| 3,890,986 | 6/1975 | Gerlich | 132/84 A |
| 4,411,041 | 10/1983 | Braga | 15/176 X |
| 4,543,679 | 10/1985 | Rosofsky et al. | 15/176 X |
| 4,580,588 | 4/1986 | Swope, Jr. | 401/286 X |

FOREIGN PATENT DOCUMENTS

| | | | |
|---|---|---|---|
| 2546712 | 4/1977 | Fed. Rep. of Germany | 15/176 |
| 3038895 | 8/1982 | Fed. Rep. of Germany | 15/176 |
| 73285 | 9/1960 | France | 132/84 R |
| 2044089 | 10/1980 | United Kingdom | 15/176 |

*Primary Examiner*—Steven A. Bratlie

*Attorney, Agent, or Firm*—Dorsey & Whitney

[57] ABSTRACT

A personal, oral hygiene instrument is provided that incorporates a replaceable tooth engaging element and a dental filament dispenser into a single, hand held instrument. The instrument includes a hand graspable base member having an internal chamber for storing and dispensing dental filament from one end of the base member. A replaceable tooth engaging cleaning element is detachably received at the opposed end of the hand graspable base member.

1 Claim, 1 Drawing Sheet

ORAL HYGIENE APPARATUS HAVING REPLACEABLE TOOTH ENGAGING CLEANING ELEMENT AND INTERNAL DENTAL FILAMENT DISPENSER

TECHNICAL FIELD

The present invention relates to personal oral hygiene. In particular, it relates to an apparatus that incorporates a dental filament dispenser and a disposable tooth engaging cleaning element into a single hand held instrument.

BACKGROUND ART

Basic oral hygiene begins with the proper brushing and flossing of teeth. Brushes for scrubbing teeth and dental filament for flossing teeth are inherently disposable items. Brush bristles become fatigued and worn with use and a single length of dental filament can only be used for one cleaning application. As a result, toothbrushes and dental filament dispensers have been traditionally manufactured from low cost materials and are designed as low value, throw away items. A personal oral hygiene instrument that could economically incorporate replaceability of brush elements and dental filament into a hand held, permanent instrument would find ready acceptance from general consumers and dental hygienists.

SUMMARY OF THE INVENTION

The present invention successfully incorporates replaceability of tooth engaging brush elements and dispensing of dental filament into a single, permanent, hand held instrument. The oral hygiene apparatus in accordance with the present invention broadly includes a replaceable brush assembly detachably coupled to a hand held base member. The hand held base member includes an internal chamber from which dental filament is replaceably stored and from which the filament can be dispensed. A first embodiment of the invention is particularly designed to accommodate molding of the base member from synthetic resins. A second embodiment of the invention allows for construction of the base member from high value, nonflexible materials such as porcelain or the like.

DETAILED DESCRIPTION OF THE DRAWINGS

Figures 1, 2, 3, 4, 5, 6, 7, 8, 9, 10, 11:
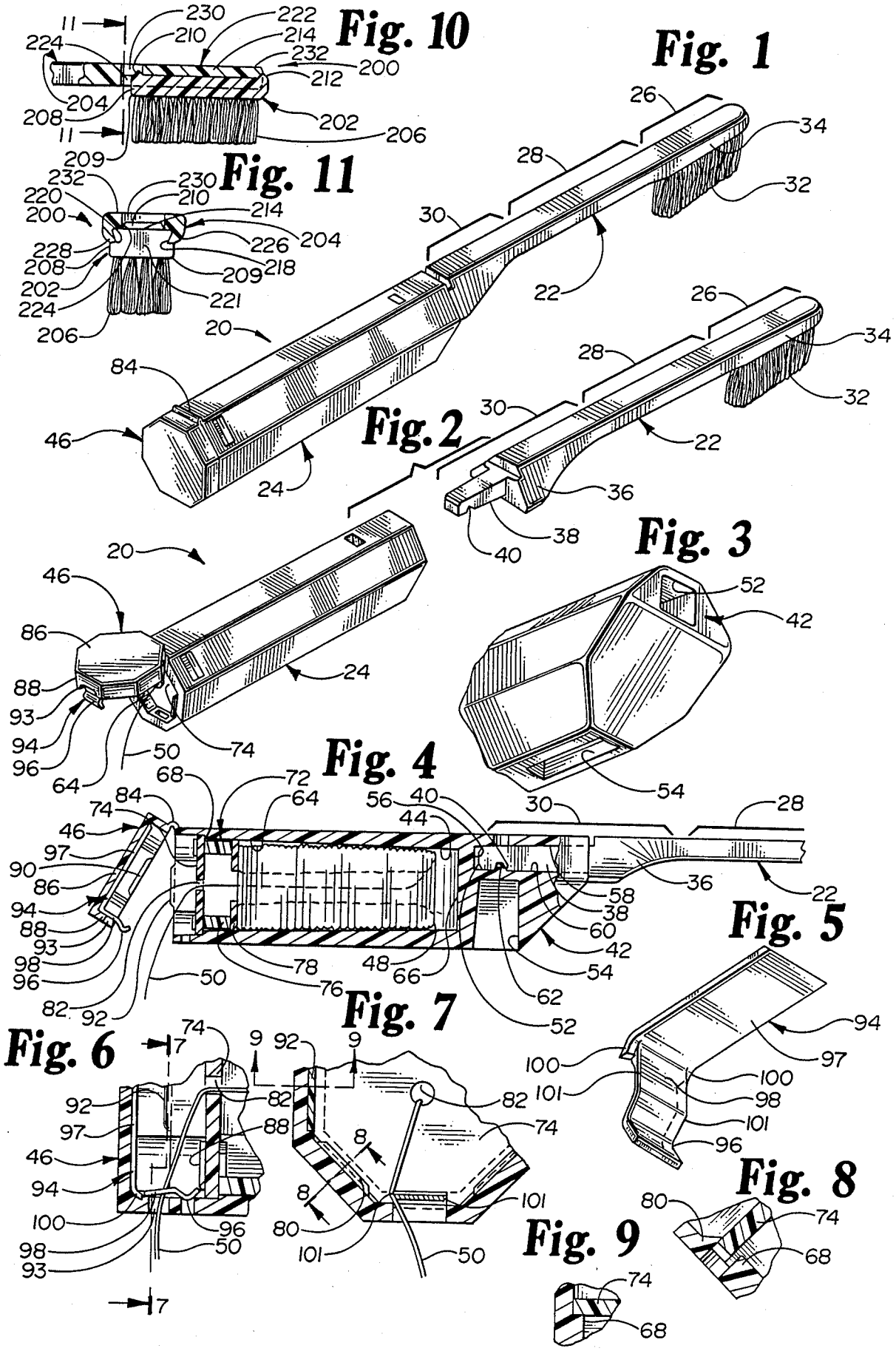
FIG. 1 is a perspective view of an oral hygiene apparatus in accordance with the invention.
FIG. 2 is a perspective view of the invention partially disassembled.
FIG. 3 is a fragmentary, perspective view of the hand held base of the oral hygiene apparatus depicted in FIGS. 1 and 2.
FIG. 4 is a fragmentary, sectional view of the apparatus depicted in FIGS. 1 and 2.
FIG. 5 is a perspective view of the cap latching spring of the apparatus.
FIG. 6 is a fragmentary, sectional view depicting the cap of FIG. 4 in the closed position.
FIG. 7 is a fragmentary, sectional view taken along the line 7—7 of FIG. 6.
FIG. 8 is a fragmentary, sectional view taken along the line 8—8 of FIG. 7.
FIG. 9 is a fragmentary, sectional view taken along the line 9—9 of FIG. 7.
FIG. 10 is a side elevational view of an alternative embodiment of the invention with parts cut away.
FIG. 11 is a sectional view taken along the line 11—11 of FIG. 10.

Referring to the drawings, an oral hygiene apparatus 20 is depicted that includes a brush assembly 22 detachably coupled to a hand-held base member 24. The apparatus 20 is shown fully assembled in FIG. 1, and disassembled in FIG. 2.

The brush assembly 22 includes tooth engaging cleaning element 26, neck portion 28, and attachment mechanism 30. The cleaning element 26 comprises a plurality of bristles 32 fixedly retained within bristle base 34.

Attachment mechanism 30 is integrally formed with neck portion 28. As is best depicted in FIG. 2, the attachment mechanism 30 includes base portion 36 having a frusto-triangular cross section and attachment boss 38 projecting outwardly from the base portion 36, and generally along the axis defined by neck portion 28. Attachment boss 38 includes rib receiving groove 40.

Hand held base member 24 comprises a generally octagonal in cross section body having brush assembly receiving portion 42, internal chamber 44, and cap portion 46. Dental filament bobbin 48, formed from a strand of dental filament 50, is removably received within internal chamber 44.

Brush assembly receiving portion 42 includes receptacle 52 and detent distortion relieving cavity 54. Receptacle 52 includes end wall 56, top wall 58, and bottom wall 60, all connected by opposed sidewalls. Detent engaging rib 62 projects upwardly from bottom wall 60. As can best be seen in FIG. 4, the detent engaging rib 62 is received within groove 40 of attachment boss 38. Cavity 54 provides bottom wall 60 with a thin, flexible width proximal to detent engaging rib 62. The attachment boss 38 of brush assembly 22 is matingly, snapably received within receptacle 52 in a complementary fit.

Internal chamber 44 is defined by chamber sidewall 64 and chamber end wall 66. The chamber sidewall 64 defines a chamber diameter that decreases in size along the base member axis from the opening of the chamber 44 to the end wall 66. A counterbore set in the opening of internal chamber 44 presents shoulder 68.

Bobbin cover assembly 72 includes cover disk 74, spacer 76, and washer 78. Cover disk 74 is snapably retained against shoulder 68 by retaining ribs 80. The cover disk 74 includes a central, dental filament receiving aperture 82.

Cap portion 46 of base member 24 is pivotally connected to the body of base member 24 by integral hinge 84. The cap portion 46 includes end wall 86 and sidewall 88. The sidewall 88 is complementary in shape to the sidewall of the body of base member 24. The cap sidewall 88 includes registration grooves 90. Registration ribs 92 project axially outwardly from the body of base member 24, and are matingly received by sidewall registration grooves 90. Dental filament receiving notch 93 in cap 46 provides an opening through which can exit dental filament internal chamber 44.

Leaf spring latch 94 is retained within cap portion 42. The latch includes V-shaped detent 96 integrally attached to latch base 97 by latch neck 98 Opposed spurs 100 provide for positive seating of the latch 94 within the cap portion 42. The beveled margins 101 of the latch 94 provide filament severing knife edges. Referring to FIG. 6, it will be seen that the base member 24 is provided with latching aperture 102 for snapably receiving the V-shaped detent 96 of latch 94.

A second embodiment 200 of an oral hygiene apparatus in accordance with the present invention is depicted in FIGS. 10 and 11. The oral hygiene apparatus 200 includes a tooth engaging cleaning element 202 detachably coupled to neck portion 204. Neck portion 204 is part of a handle portion (not shown in FIGS. 10 and 11) that is similar to the hand held base member 24 of the apparatus 20 in accordance with the first embodiment of the invention. Neck portion 204, however, may be integrally formed with the handle portion. Accordingly, the handle and neck portion can be made as a unitary piece from a high value, nonflexible material such as porcelain or the like.

The cleaning element 202 includes a plurality of bristles 206 fixedly retained at bristle receiving surface 209 of bristle base 208. The bristle base 208 is advantageously formed from a flexible, elastomeric material and includes retention ribs 210, 212 that extend outwardly from bristle base top surface 214. As best seen in FIG. 11, bristle base 208 includes neck receiving channels 218, 220. The neck receiving channels 218, 220 together define a bristle base boss 221.

Neck portion 204 includes cleaning element receiving end portion 222. End portion 222 includes element receiving channel 224 defined by opposed, inwardly facing marginal flanges 226, 228. Rib receiving aperture 230 extends between the top surface 232 of neck 204 and the channel 224.

In operation, the oral hygiene apparatus 20 is used in its fully assembled configuration as depicted in FIG. 1. Dental filament 50 is dispensed through filament receiving aperture 82 and cap notch 93 by pulling on the tag end of the dental filament 50. Once an appropriate length of dental filament 50 has been dispensed from the internal chamber 44, the filament 50 may be severed by pulling the dental filament 50 up against the knife edge 101 of latch 94.

Brush assembly 22 is a disposable item. Once the useful life of bristles 32 has been exhausted, the brush assembly 22 may be removed from base member 24 by grasping the base member 24 and brush assembly 22 in opposite hands, and pulling the brush assembly 22 away from the base member 24. As noted above, detent rib 62 is positioned along a thin portion of cavity bottom wall 60 and will deflect downwardly, as the brush assembly 22 and base member 22 are pulled apart, disengaging detent rib 62 from the groove 40 of brush assembly attachment boss 38.

A new brush assembly 22 may be attached to base member 24 by simply inserting the attachment boss 38 of the new brush assembly 22 into the receptacle 52 of hand held base member 24. The detent rib 62 will be deflected downwardly upon engagement of the rib with the leading end of the attachment boss 38. Once the groove 40 of the attachment boss 38 is aligned with detent engaging rib 62, the detent rib 62 will snap into position within the groove 40, locking the new brush assembly into place. The complementary fit of the attachment boss 38 within receptacle 52 provides a secure coupling between the hand held base member 24 and the new brush assembly 22.

Referring to FIG. 4, it will be appreciated that the bobbin 48 of dental filament 50 is held within internal chamber 44 by a gentle force fit. In particular, the inwardly tapered sidewalls of the internal chamber 44 compress the bobbin 44 as it is inserted into internal chamber 44, gently wedging the bobbin 48 within the chamber 44. Cover assembly 72 abuts against the bobbin 48, securely retaining the bobbin 48 within the internal chamber 44. Note that washer 78 is positioned within the internal chamber 44 by spacer 76. Washer 78 can be positioned deeper or shallower within the internal chamber 44 by replacing the spacer 72 with a longer or shorter spacer, thereby accommodating dental filament bobbins of different axial lengths.

Bobbin 48, once fully dispensed, can be replaced by a new bobbin. This is accomplished by pivoting cap assembly 46 away from the body of hand held base member 24, and removing cover assembly 72. The new bobbin 48 is then inserted within chamber 44, cover assembly 72 is installed within the internal chamber 44, and cap assembly 46 is snapably repositioned to its closed position.

Referring to FIGS. 10 and 11, tooth engaging cleaning element 202 in accordance with the second embodiment of the present invention can be removed from the neck 204 by forcing the bristle base 208 outwardly through the retention channel 224. The sloped face of rib 210 facilitates removal of the bristle base 208 from the channel 224. Alternatively, rib 210 can be depressed by extending a tool through aperture 230 to assist the removal of the cleaning element 202 from the neck 204. A new cleaning element 200 can be easily reinserted into the channel 224 formed by the neck 204. Retention ribs 210, 212 snapably retain the cleaning element 202 to the neck 204.

I claim:

1. A combination toothbrush and dispenser for dental filament wound into a dental filament bobbin, said bobbin defining a bobbin external diameter, comprising:

a generally tubular, hand graspable base member having generally opposed ends along a base member axis and defining an internal chamber for receiving said bobbin, said internal chamber presenting an opening at one of said ends and a chamber end wall opposite said opening, said internal chamber defining a chamber axis generally along said base member axis, and having a chamber depth measured along said chamber axis, and a chamber diameter decreasing in size along said chamber axis in a direction from said opening to said end wall from a size larger than said bobbin external diameter to a size smaller than said bobbin diameter whereby said filament bobbin is received within said internal chamber in a force fit;

means for retaining said bobbin within said internal chamber, including a generally annular retaining member removably received within said internal chamber in confining engagement with said bobbin, a generally annular cover member spaced apart from said retaining member along said chamber axis, said cover member being snapably, detachably positioned within said internal chamber, and a removable spacer member interposed between said retaining member and said cover member, said spacer member having an axial length such that the position of said retaining member within said internal chamber is determined by said axial length of said spacer member, whereby filament bobbins of different sizes can be retained within said internal chamber by the use of spacer members having different axial length, said retaining member and said spacer member each having structure defining generally centered apertures such that said filament can be dispensed from said internal chamber through said apertures;

a tooth engaging cleaning element comprising a brush having an elastomeric bristle base having a bristle receiving surface and an opposed bristle base top surface, and a plurality of bristles operably carried by said bristle base bristle receiving surface; and means operably coupling said tooth engaging element to said base member including a rigid elongated neck portion having a first end operably coupled to said base member and an opposed bristle base receiving end including structure defining a bristle base receiving channel and a receiving end top surface opposed to said receiving channel, said bristle base top surface including first and second opposed upwardly projecting retention ribs, said elongated neck portion including an outer margin and structure defining a rib receiving aperture extending through said bristle base receiving end from said receiving end top surface to said receiving channel, said rib receiving aperture presenting opposed, front and rear aperture walls, and said rib receiving aperture being spaced inwardly from said outer margin, said first retention rib snapably receivable within said rib receiving aperture and said second retention rib abutably engageable with said outer margin whereby said bristle base is detachably retained by said neck portion, said first retention rib including a sloped face engageable with said rib receiving front wall, said rib receiving aperture providing access to said first retention rib for urging said sloped face against said rib receiving front wall to facilitate removal of said bristle base from said neck portion.

* * * * *